US007963366B2

(12) United States Patent
Christianson

(10) Patent No.: US 7,963,366 B2
(45) Date of Patent: Jun. 21, 2011

(54) SPLIT TUBE BELAY DEVICE

(76) Inventor: Tony Christianson, Yosemite National Park, CA (US)

( * ) Notice: Subject to any disclaimer, the term of this patent is extended or adjusted under 35 U.S.C. 154(b) by 1081 days.

(21) Appl. No.: 11/706,888

(22) Filed: Feb. 14, 2007

(65) Prior Publication Data

US 2007/0187176 A1 Aug. 16, 2007

Related U.S. Application Data

(60) Provisional application No. 60/774,829, filed on Feb. 16, 2006.

(51) Int. Cl.
*A62B 1/16* (2006.01)

(52) U.S. Cl. ..... 182/5

(58) Field of Classification Search ..... 182/5, 191–193; 188/65.3, 65.4
See application file for complete search history.

(56) References Cited

U.S. PATENT DOCUMENTS

| | | | | |
|---|---|---|---|---|
| 641,809 | A | 1/1900 | Tillottson | |
| 4,311,218 | A | 1/1982 | Steffen | |
| 4,333,551 | A | 6/1982 | Shefrin | |
| 4,531,610 | A * | 7/1985 | Fertier et al. | 182/5 |
| 4,645,034 | A * | 2/1987 | Griffith | 182/231 |
| 4,678,059 | A | 7/1987 | Bowker | |
| D297,811 | S | 9/1988 | Payan | |
| 4,883,146 | A | 11/1989 | Varner | |
| 5,217,092 | A | 6/1993 | Potter | |
| 5,360,083 | A | 11/1994 | Hede | |
| 5,577,576 | A * | 11/1996 | Petzl et al. | 188/65.4 |
| 5,597,052 | A | 1/1997 | Rogleja | |
| 5,671,822 | A | 9/1997 | Phillips | |
| 5,855,251 | A | 1/1999 | Deuer | |
| 5,860,493 | A | 1/1999 | Cherpitel | |
| 5,924,522 | A | 7/1999 | Ostrobrod | |
| 5,934,408 | A | 8/1999 | Flux | |
| D413,786 | S | 9/1999 | Graham | |
| 5,975,243 | A | 11/1999 | Lorbek | |
| 6,009,977 | A | 1/2000 | Pelofi | |
| 6,029,777 | A | 2/2000 | Rogelja | |
| 6,085,866 | A | 7/2000 | Kowalewski | |
| 6,095,282 | A | 8/2000 | Sadeck | |
| 6,095,502 | A | 8/2000 | Dodge | |
| 6,378,650 | B2 | 4/2002 | Mauthner | |
| 6,382,355 | B1 | 5/2002 | Kowalewski | |
| 6,446,936 | B1 | 9/2002 | Ostrobrod | |
| 6,467,574 | B2 | 10/2002 | Lara | |
| D466,794 | S | 12/2002 | Malkiel | |
| 6,561,313 | B2 | 5/2003 | Hewlett | |
| 6,681,891 | B2 | 1/2004 | Richard | |
| 6,772,483 | B1 | 8/2004 | Saunders | |
| 6,843,346 | B2 | 1/2005 | LeBeau | |
| 7,055,651 | B2 | 6/2006 | Klingler | |

* cited by examiner

*Primary Examiner* — Alvin C Chin-Shue

(57) ABSTRACT

The instant invention is a climbing device for belaying and rappelling. A tube is split into two parts that are hinged to pivot scissor-like. A loop of rope is inserted into the split tube and attached to the climber or an anchor with a carabiner. The split tube is open when the rope is slack and retains the one-piece tube belay device's characteristic advantages of smooth feed. The two parts pivot when there is tension in the rope, closing around the rope in a scissor-like movement that increases friction by pinching the rope against the carabiner, significantly reducing the brake-hand force needed to arrest and hold the weight of a climber. At least one spring applies the force that opens the spit tube when the device is not supporting a load. Alternate configurations include openings to control two ropes simultaneously; a lever to control the release of the rope when lowering a climber; and a means for attaching a second carabiner for rigging the device to belay a second with auto-braking. The instant invention is effective with climbing ropes of any diameter and can arrest rope moving through the device in either direction.

14 Claims, 5 Drawing Sheets

SPLIT TUBE BELAY DEVICE

CROSS-REFERENCE TO RELATED APPLICATIONS

The instant invention is related to Provisional Application No. 60/774,829 entitled "Split tube belay device," filed Feb. 16, 2006, the disclosure of which is incorporated herein by reference.

BACKGROUND OF THE INVENTION

1. Field of the Invention

The instant invention is generally related to climbing aids for rock climbers. More particularly, this invention is related to devices for belaying and rappelling.

2. Description of the Prior Art

Climbers utilize rope, slings and a variety of mechanical devices as climbing aids to assist and protect their movement over rock. The climbing aids serve as a means to anchor the climber to the rock for the purpose of either preventing or arresting a fall.

One end of a rope is attached to the climber's body harness. As the climber ascends, the rope is attached by carabiners to various climbing aids that have been inserted in or on the rock for the purpose of serving as anchors. The carabiners facilitate movement of the rope past the anchor as the climber ascends. The rope typically threads through a series of anchors along the climber's route.

Climbing ropes are designed to stretch under load and absorb the impact of a fall. The ropes come in different diameters and lengths. Ropes having a diameter from 8 to 9 millimeters are usually used in pairs. Ropes having a diameter of 10 to 11 millimeters are usually used singly. The choice of rope diameter and the use of single or paired ropes are dependent on personal preference or the custom at the area climbed.

A belayer is a member of a climbing team whose function is to remain stationary at a secure location and regulate the flow of rope to the lead climber. As the lead climber progresses, the belayer must carefully observe the movement of the climber and feed rope out or take it in as appropriate. If the climber falls, the belayer must immediately control the rope so that the fall is arrested.

When the lead climber is at a secure location, the lead climber can assume the roll of belayer by pulling up the rope as the second climber or climbers (the climber or climbers following the leader) ascend the route (called "belaying a second" or "belaying the second"). In the event that a second climber falls, the lead climber must immediately control the rope so that the fall is arrested.

Belay devices serve as mechanical aids that provide the belayer a means to control the rope's movement, especially in the event of a fall. There are several types of belay devices; each type handles the rope differently. The various belay devices have fundamentally different functional characteristics that must be completely understood in order to use them safely. As with any climbing aid, training is required to achieve the skill necessary to use a belay device properly.

Some belay devices also serve as an aid for rappelling. When rappelling, a climber descends a rope by letting the rope slide slowly through the device. The device is clipped to the climber's harness. When used for this purpose, the device helps the climber control the speed of descent, and provides the ability to stop completely.

although belaying and rappelling are seemingly simple procedures, both require complete attention and commitment. The belayer is responsible for caching a climber's fall.

When rappelling, an unaware climber can loose control of the rope and consequently descend too fast and/or drop off the end of the rope.

There are occasions during the course of a climb when the lead climber will take a long time to move even a short distance. During such periods of little apparent progress, the belayer may desire to work at other tasks or otherwise be distracted. Any distraction is especially dangerous because if a climber falls when the belayer is distracted an the rope starts moving quickly, the rope will be significantly more difficult to bring under control.

The instant invention is a climbing aid that can be used for both belaying and rappelling. All references in this application referring to the instant invention as a belay device are intended to also include use for rappelling.

State-of-the-art belay devices include cams, plates, rings and tubes of various configurations, all designed to generate friction and/or grab the rope when activated. The amount of friction is typically controlled the angle the rope enters and leaves the device.

Some devices, especially those that utilize cams, provide a static belay by grabbing the rope quickly and automatically (called "auto-locking devices".) Auto-locking devices usually include a lever to release the rope after the device has arrested the fall and "locked". Other devices provide a dynamic belay or "soft" stop by allowing the rope to slip a short distance before arresting a fall. However, the amount of slippage must be limited because a falling climber can be injured if allowed to hit something before stopping.

In addition to controlling the rope in the event of a fall, the rope should also slide quickly and smoothly through the device and not tangle or twist when the belayer feeds rope or takes rope back according to the needs of the progressing climber. Typically, those devices that stop the rope softly also feed rope smoothly.

The tube belay device is one of the more commonly utilized state-of-the-art belay devices. A tube belay device relies on friction to softly arrest movement of the rope. Typically, a bight or loop of rope is inserted into and through the tube and clipped by means of a carabiner to the belayer's harness, or independent secure anchor. One of the belayer's hands is used to pull rope through the device according to the needs of the climber. The other hand, referred to as the "brake-hand", guides the rope into the device, pulls rope back when there is slack, the controls when the belay device is needed to arrest the rope.

State-of-the-art tube belay devices are configured to handle two ropes in parallel. The width of the tube belay device is sized to accommodate two ropes side-by-side, and includes a short rib across the opening to maintain separation of the two ropes. This two-rope capability gives the option to use the device when pairs of small diameter ropes are used; and for simultaneously belaying one or two second climbers.

When slack rope is loosely fed directly into a tube belay device, the rope loop slides easily around the carabiner and moves relatively smoothly through the device with little friction. However, if the belayer restrains or "brakes" the rope as it feeds into the tube belay device, the friction generated as the rope moves past the tube entrance, combined with the rope's tension, will pull the loop, and the carabiner with it, tightly against the tube opening. Surface contract between the rope, the belay device, and the carabiner, along with the angle that the rope enters and exits the tube; create the friction that enables the belayer to arrest a fall.

A state-of-the-art tube belay device requires that the belayer's brake-hand maintain a strong grip on the rope to arrest and hold the weight of a fallen climber. Generally, tube belay devices stop and hold larger diameter ropes more effectively than small diameter ropes. Consequently, smaller diameter ropes must be gripped by the brake-hand relatively more tightly to hold the weight of a climber.

Some state-of-the-art tube belay dives include a means for directly attaching a second carabiner to rig the device for belaying a climber ascending from below (belaying the second) with the added capability of "auto braking". When rigged to belay the second with auto-braking, the device allows rope movement in one direction only; rope movement in the reverse direction is auto-braked thereby catching the fall of a second without intervention by the belayer (although it is prudent to maintain brake-hand backup). When state-of-the-art tube belay devices are rigged for auto-braking, it is difficult to play out slack when the second needs it, and when auto-braking is engaged it is very difficult to release a loaded rope (for example to lower a climber).

SUMMARY OF THE INVENTION

The instant invention is a climbing device for belaying and rappelling. A tube is split into two parts that are hinged to pivot scissor-like. A loop of rope is inserted into the split tube and attached to the climber or an anchor with a carabiner. The split tube is open when the rope is slack and retains the one-piece tube belay deices's characteristic advantages of smooth feed. The two parts pivot when there is tension in the rope, closing around the rope in a scissor-like movement that increases friction by pinching the rope against the carabiner, significantly reducing the brake-hand force needed to arrest and hold the weight of a climber. At least one spring applies the force that opens the spit tube when the device is not supporting a load. Alternate configurations include openings to control two ropes simultaneously; a lever to control the release of the rope when lowering a climber; and a means for attaching a second carabiner for rigging the device to belay a second with auto-braking. The instant invention is effective with climbing ropes of any diameter and can arrest rope moving through the device in either direction.

DESCRIPTION OF THE DRAWINGS

A detailed description of the invention is made with reference to the accompanying FIGS. wherein like numerals designate corresponding parts in the several FIGS.

DESCRIPTION OF THE PREFERRED EMBODIMENT

The following detailed description is of the best presently contemplated modes of carrying out the invention. This description is not to be taken in a limiting sense, but is made merely for purposes of illustrating the general principles of the invention.

Figure 1:
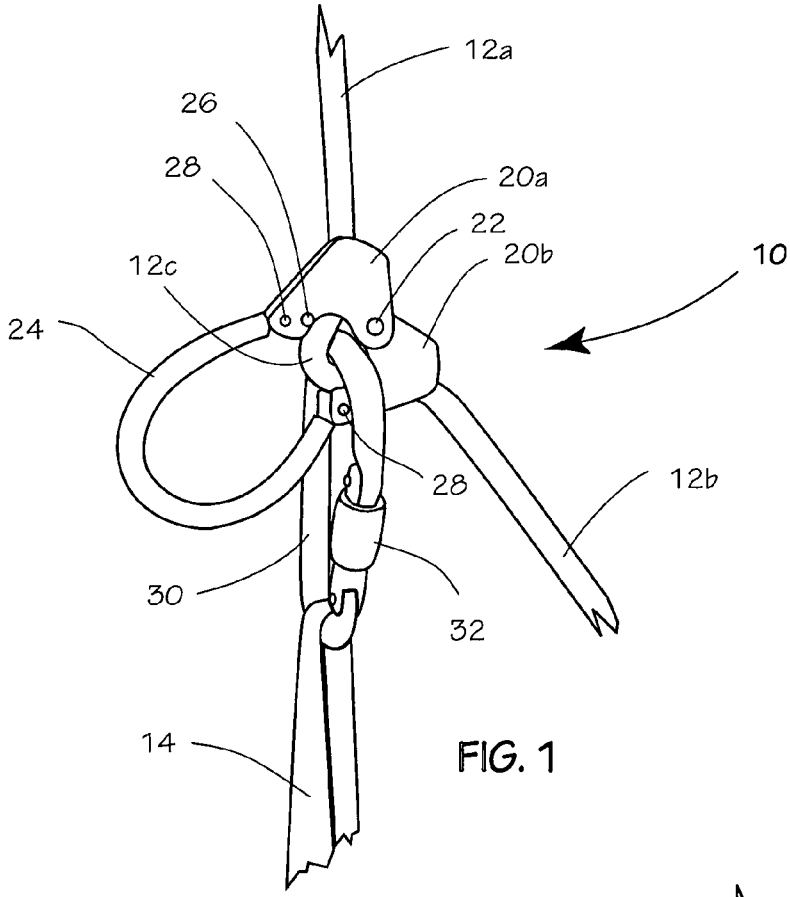
FIG. 1 is an oblique view of the inventive climbing device holding a rope attached to a carabiner.
Figure 2:
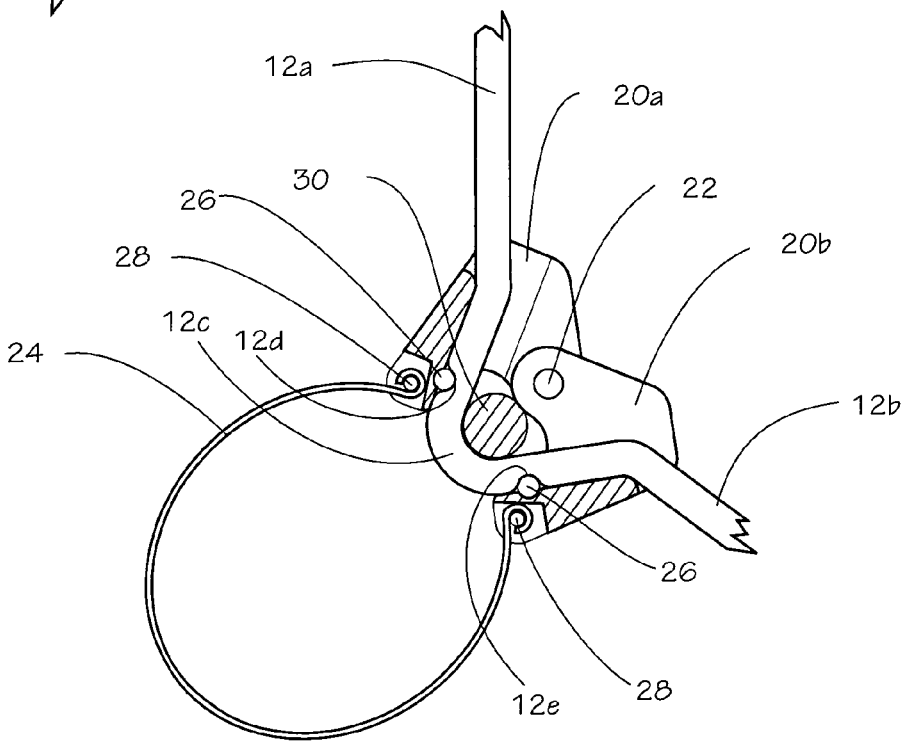
FIG. 2 is a front sectional view of the climbing device of FIG. 1 closed and clamping the rope.

Referring to FIGS. 1 and 2, inventive climbing device 10 is attached to climbing rope 12. Rope 12 is shown above and below climbing device 10 as 12*a* and 12*b* respectively. A short loop of rope 12*c* is inserted into climbing device 10. Typically, the end of rope 12*a* is attached to an ascending climber (not shown). Rope 12*a* is taut in FIGS. 1 and 2 because climbing device 10 is pictured holding a tensile load caused, for example, by the weight of a climber hanging form the end of rope 12*a*. Rope 12*b* is held by the belayer's brake-hand (not shown).

Carabiner 30 is shown passing inside looped spring 24 and rope loop 12*c*. Carabiner 30 links climbing device 10 and rope loop 12*c* to webbing 14. Climbers prudently employ a locking carabiner when using a climbing device for belaying. Sleeve 32 is the mechanism that locks the gate of carabiner 30 closed. Webbing 14 can be part of or attached to the belayer's body harness, or carabiner 30 can be attached by webbing, rope, or the like to any secure anchor.

Figure 3:
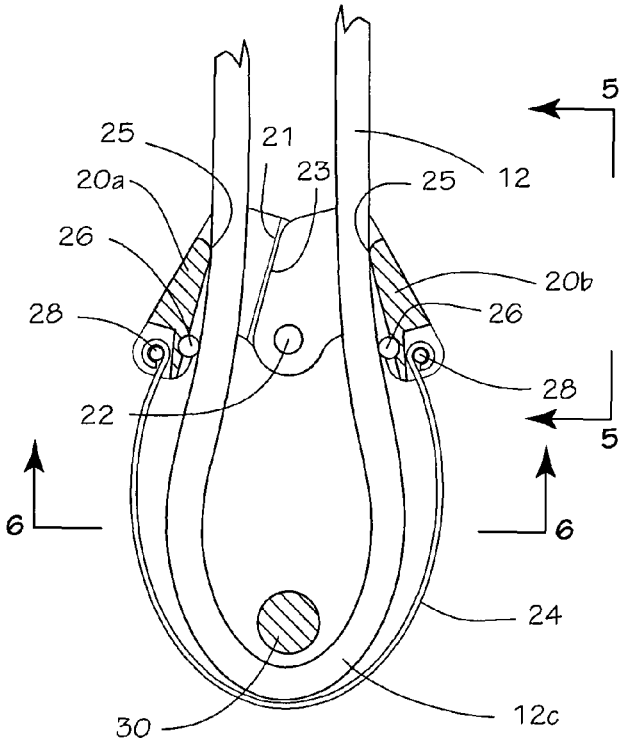
FIG. 3 is a front sectional view of the inventive climbing device showing the device open so that rope can move loosely through it.

FIGS. 2 and 3 are cross-section side views showing rope 12 looped into climbing device 10 around carabiner 30 (only partially pictured as circular section 30 in FIGS. 2, 3, 4, 7 and 8). FIG. 2 shows the closed inventive device holding rope 12 under tension. FIG. 3 shows the device open with rope 12 slack and able to move freely in either direction.

Climbing device 10 has a two piece body 20*a* and 20*b* hinged together on both sides by pivot pins 22. Pivot pins 22 have a common axis of rotation. Looped spring 24 applies the force that opens body 20*a* and 20*b* to the position pictured by FIG. 3. Shelf 21 (best seen in FIG. 6) on body 20*a* serves as an abutment for edge 23 of body 20*b* to limit opening movement. Alternately shelf 21 can be replaced by pin 60*b* or-the-like (see FIG. 7). The ends of looped spring 24 are attached to body 20*a* and 20*b* by pins 28. Alternately, looped spring 24 can be replaced by torsion or coiled spring 60 or-the-like adjacent pivot pins 22 (see FIG. 10).

Although not limited to the suggested materials, body 20*a* and 20*b* are best fabricated from a lightweight, high strength rigid material, for example 7075-T6 aluminum. Spring 24 is a leaf spring fabricated from strip spring steel. Alternately springs 24 and 60 can be fabricated from spring wire or any springy material of adequate strength. Pens 22 and 28 are standard dowel pins of appropriate diameter and length. Alternately pins 22 and 28 can be rivets or threaded fasteners, or the like.

Rope 12 is inserted as a loop into inventive climbing device 10 as shown by FIG. 3. Inserting a loop of rope allows the device to be mounted anywhere along the rope's length. After the loop has been threaded into climbing device 10, carabiner 30 is clipped inside both loop 12*c* and looped spring 24. By clipping carabiner 30 inside looped spring 24, spring 24 also serves to limit the distance that carabiner 30 can move away from body 20*a* and body 20*b*.

Spring 24 holds body 20*a* and 20*b* open when there is not tension in rope 12. As long as rope 12 is guided into climbing device 10 without restriction (as shown by FIG. 3), rope loop 12*c* will loosely curve around carabiner 30 and rope 12 will move smoothly through climbing device 10 without hindrance.

Figure 5:
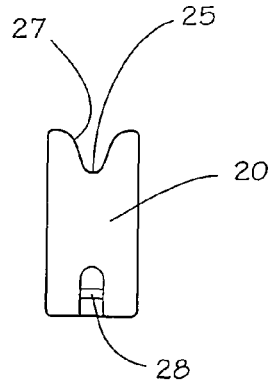
FIG. 5 is a slide view shown in the direction 5-5 of FIG. 3.

In the event of a fall, the belayer must immediately respond be grasping and pulling rope 12*b* to the side with the brake-hand. When rope 12*b* is constrained and pulled to the side, friction is generated where the rope is forced against corner 25 of body 20. The friction generated at corner 25 is enhanced by notch 27 (FIG. 5). Alternately, notch 27 can be eliminated.

Constraining and frictional forces impede rope movement into climbing device 10. The resultant tension will pull loop 12*c*, and carabiner 30 with it, tightly against body 20. Surface contact between rope 12, body 20, and carabiner 30 create additional friction. As the tension in rope 12 increase, the rope will be increasingly forced against corners 25 of both body 20*a* and body 20*b*, causing climbing device 10 to close by pivoting around pins 22. Pivoting around pins 22 will decrease the size of the opening adjacent carabiner 30 thereby pinching and forcing rope 12 against carabiner 30. Pinching rope 12 against carabiner 30 greatly increases the friction forces arresting movement of rope 12.

Pins 26 facilitate pinching rope 12 against carabiner 30 by deforming the rope's sheath at 12*d* and 12*e*. Pins 26 can be dowel pins, key stock having square cross-section (see FIGS. 7 and 8), rivets, threaded fasteners, or the like, of appropriate length. Because pins 26 are typically made of steel harder than the lightweight material of body 20, pins 26 also serve to reduce or prevent wear of body 20.

Alternately, the inventive climbing device an be configured without pins 26 by forming or machining appropriate protrusions on the interior walls of body 20; or by having no protrusions at all and relying on the smooth interior walls of body 20 to provide friction with the rope when the opening adjacent carabiner 30 is decreased in size.

Figure 4:
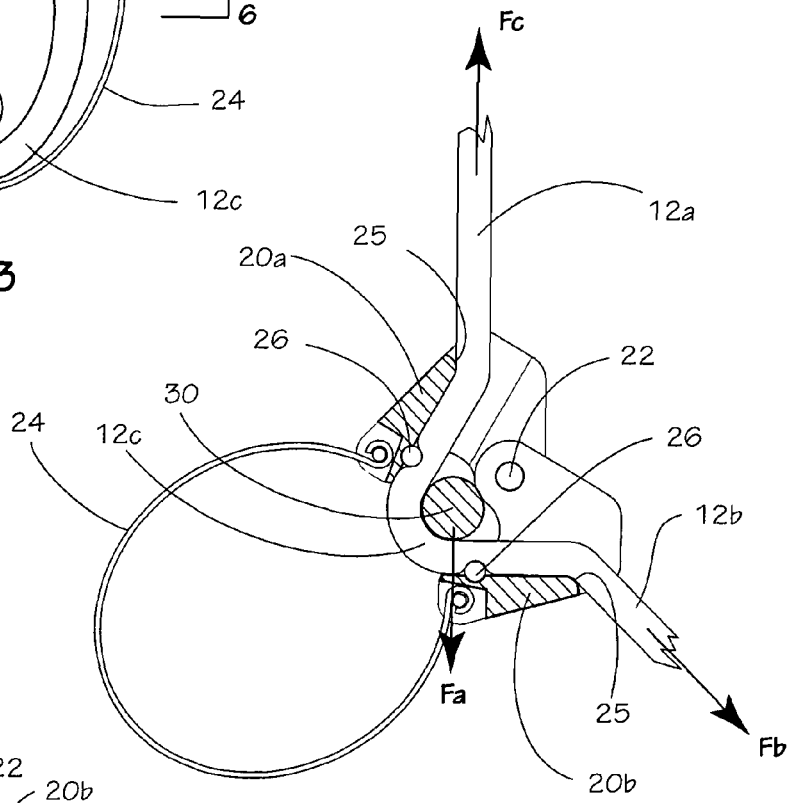
FIG. 4 is a view similar to FIG. 2 showing the forces acting on the device.

FIG. 4 shows the external forces at play when climbing device 10 is holding the weight of a climber. Fc is the tension in rope 12*a* due to the weight of the climber. Fa is the force being transmitted by the carabiner to the anchor. Fb is the pulling force of the brake-hand. Without friction, Fc will equal Fb, and there will be little or no Fa. As friction increases, more and more force will be transferred from Fb to Fa. Ideally, Fb will be as low as practical so as to not unduly stress or tire the belayer's brake-hand, consequently the increased friction generated by the inventive climbing device's ability to pinch the climbing rope against the carabiner is very advantageous. Furthermore, the greater the weight being held, the greater the pinching force. Also, the symmetrical opening of body 20 enables climbing device 10 to be used to arrest the movement of a rope moving in either direction through the device.

After the inventive climbing device has arrested rope 12 as the result of a fall, the belayer sometimes needs to lower the climber to a safe location. Gradually releasing the grasp of the brake-hand and/or changing the rope's entrance angle to more inline with the longitudinal axis of body 20 will accomplish this. Similarly, an inadvertent arrest can be easily released by simply slacking rope 12*b*.

Figure 9:
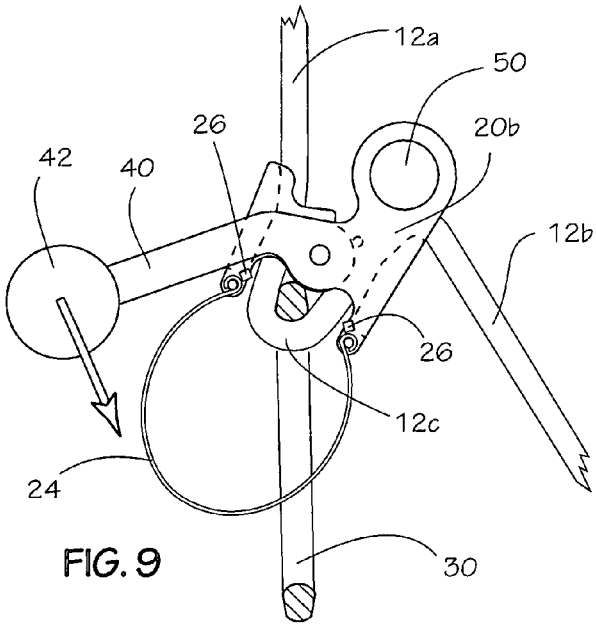
FIG. 9 is a front view of the alternate configuration of FIG. 7 showing the device during a controlled release of a load.
Figure 10:
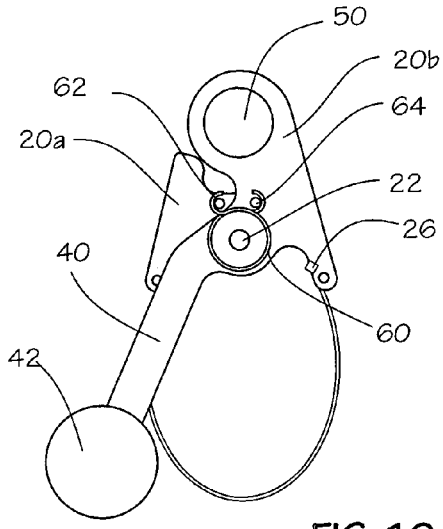
FIG. 10 is a front view of yet another alternate configuration.
Figure 11:
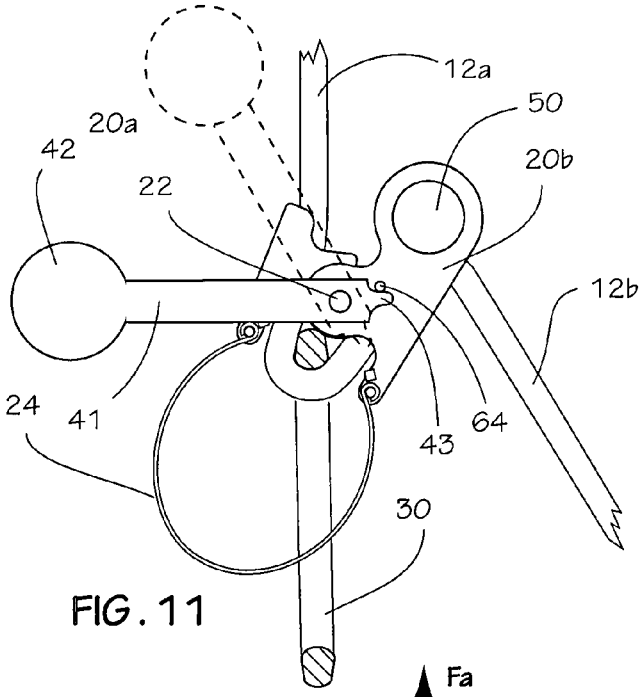
FIG. 11 is a front view of still another alternate configuration.
Figure 12:
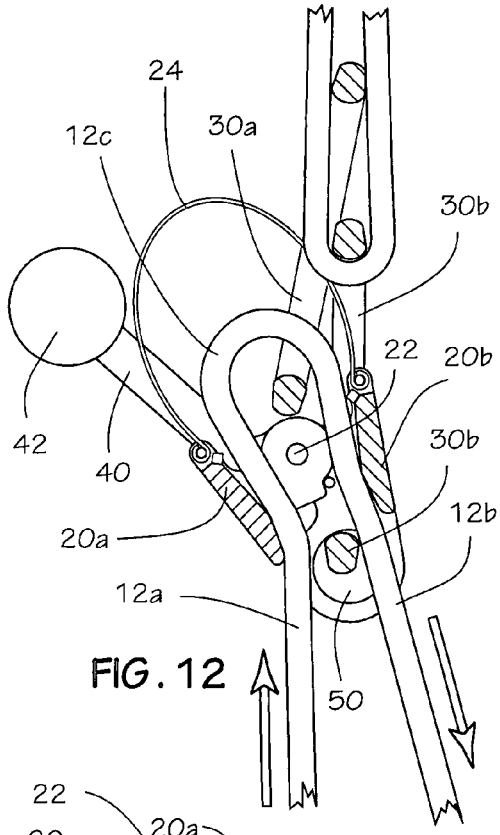
FIG. 12 is front sectional view of the configuration of FIG. 7 showing the device feeding rope when rigged for belaying a second with auto-braking.

FIGS. 7 to 12 show alternate configurations that include lever 40 to help control the gradual release of an arrested rope, for example, when lowering the weight of a climber, and also includes opening 50 on body 20*b* for directly attaching another carabiner so that the device can be rigged to belay a second with auto-braking (FIGS. 11 and 12).

Figure 7:
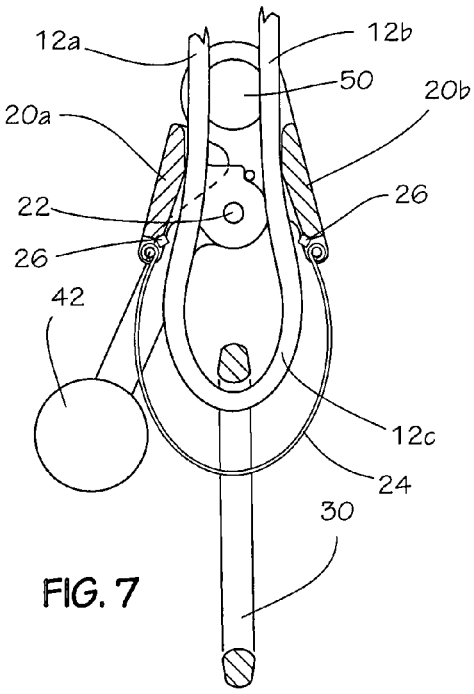
FIG. 7 is a view similar to FIG. 3 showing an alternate configuration.
Figure 8:
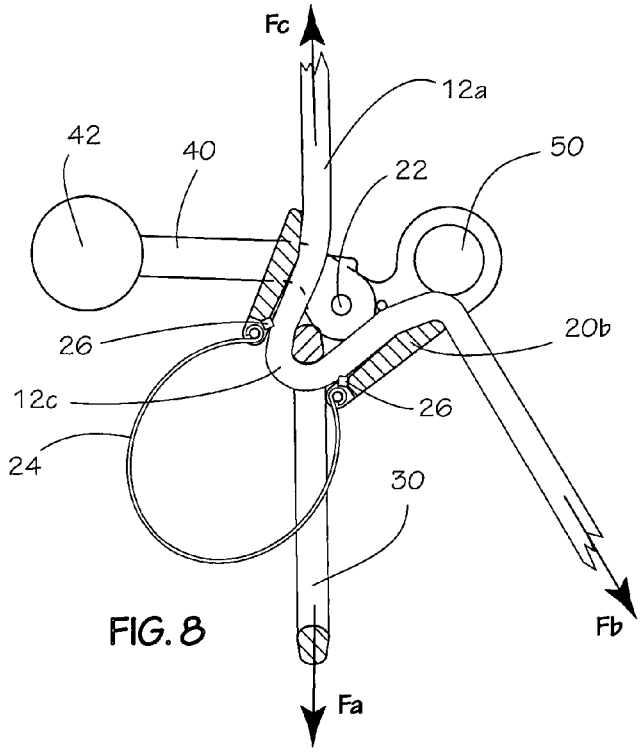
FIG. 8 is a view similar to FIG. 4 showing the alternate configuration of FIG. 7.

FIGS. 7 and 8 are cross-section side views of the alternate configuration showing rope 12 looped into the climbing device around carabiner 30. FIG. 8 shows the inventive device closed and holding rope 12*a*, which is loaded in tension. FIG. 7 shows the climbing device open with rope 12 slack and able to move freely in either direction.

As best seen in FIG. 9, lever 40 is an extension of body 20*b*. Knob 42 is located at the end of lever 40 to facilitate grasping and moving lever 40 by hand. Alternately knob 42 can be eliminated.

Using the belayer's free hand (the hand not holding rope 12*b*) to pull lever 40 in the direction of the outline arrow causes a rotational force around pivot 22 that counters the closing rotational force caused by rope 12 pushing against corners 25. When the opening rotational force caused by pulling lever 40 exceeded the closing rotational force, body 20 will start to open, separating pinch pins 26. As pins 26 separate, the frictional forces holding rope 12 decrease, which allows rope 12 to start slipping through the device. By modulating the lever force to achieve a balance with the brake-hand force, it is possible to precisely control the movement of rope 12 through the device.

FIG. 10 shows an alternate configuration in which looped spring 24 is replaced by coil spring 60, attached to body 20*a* and body 20*b* by pins 62 and 64 respectively. Coil spring 60 is advantageously located adjacent pivot 22. FIG. 10 shows coil spring 60 mounted on the outside of body 20, but spring 60 can also be mounted inside or between the sidewalls of body 20*a* and body 20*b*. Although only one coil spring 60 is shown, two coil springs can be mounted, one on each side of body 20. Furthermore, when coil spring 60 is incorporated, spring 24 is superfluous and can be replaced by loop 27. Loop 27 can be any flexible material, for example, stranded steel cable, cord or-the-like. The function of loop 27 is to limit the distance that carabiner 30 can move away from body 20.

Lever 40 facilitates the controlled release of rope 12. Lever 40 is shown as a solid extension of body 20*b* in FIG. 9. However, the lever does not need to be integral with body 20, instead the lever can be adjoined to body 20. For example, referring to FIG. 11, lever 40 is pivotally attached to body 20 by pivot pins 22. Alternately, lever 41 can be pivotally attached at locations other than pins 22. Rotational force from lever 41 is applied to body 20*a* when protrusion 43 abuts pin 64. Alternately, solid stops or abutments can be provided to transmit the rotational force from lever 41 to body 20*a* or body 20*b*. The configuration of FIG. 11 has the advantage of being able to fold lever 41 out of the way (for example, to the location of the dashed outline in FIG. 11) when not needed to control the release of rope. Similarly, lever 40 and lever 41 can be hinged anywhere along their lengths to facilitate folding out of the way.

As described supra, when "belaying the second" the lead climber is securely located and assumes the role of belayer. The lead climber must pull up and control the rope as one or more "second climbers" ascend from below. It is possible to belay the second when the device is rigged as pictured in FIGS. 3 and 7. However, a popular and convenient way to belay the second is to rig the device for auto-braking by using two carabiners as shown in FIGS. 12 and 13.

Figure 13:
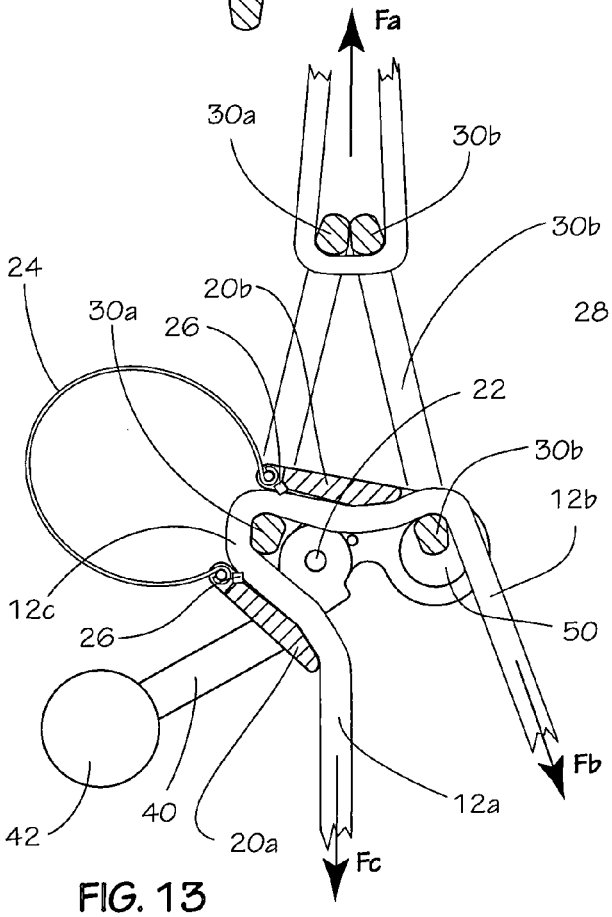
FIG. 13 is front sectional view of the configuration of FIG. 7 showing the loaded device rigged for belaying a second with auto-braking.

FIGS. 12 and 13 show loop 12*c* inserted into the inventive device and attached by carabiner 30*a* to anchor rope 14. Opening 40 body 20*b* provides the means to also attach second carabiner 30*b* to anchor rope 14. Anchor rope 14 is attached to an independently secure anchor. Rigging the inventive device with carabiners 30*a* and 30*b* as pictured in FIGS. 12 and 13 allows rope movement in one direction only; rope movement in the reverse direction in "auto-braked". Auto-braking conveniently stops the fall of a second without direct intervention by the belayer.

FIG. 12 shows how the device will orient itself when rope 12*b* is pulled downward (depicted by the outline arrows), for example when pulling up slack in rope 12*a*. FIG. 13 shows the position of the inventive device when auto-braking is engaged.

As seen in FIG. 13, when rope 12*a* is pulled downward, carabiner 30*b* limits the rotational movement of body 20*b* so that opening 50 remains approximately level with rope loop 12*c*. When the movement of body 12*b* is limited by carabiner 30*b*, continued movement of rope 12*a* will push against corner 25 of body 20*a*, causing against carabiner 30*a*.

Figure 16:
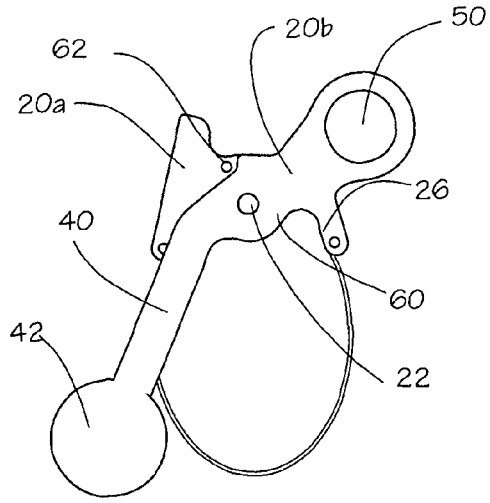
FIG. 16 is a front view of another alternate configuration.

The location of opening 50 on body 12*b* as shown in FIGS. 12 and 13 provide effective positioning of body 12*a* and body 12*b* when feeding slack rope and braking. Alternately, opening 50 can be at other locations on body 12*b*, for example to the side as shown in FIG. 16.

When auto-braking is engaged, pulling or pushing lever 40 upward toward the position of the lever in FIG. 12 will provide a controlled release of the rope and subsequent lowering of the climber. The ability to use lever 40 to release rope 12 from auto-braking is a significant advantage over the prior art.

Figure 6:
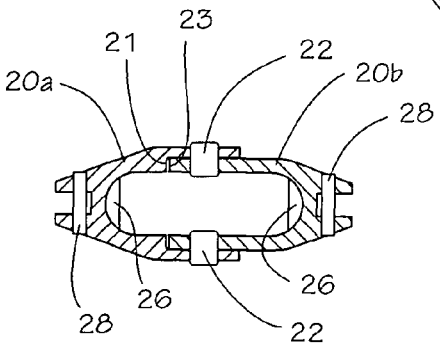
FIG. 6 is a top sectional view shown in the direction 6-6 of FIG. 3.
Figure 14:
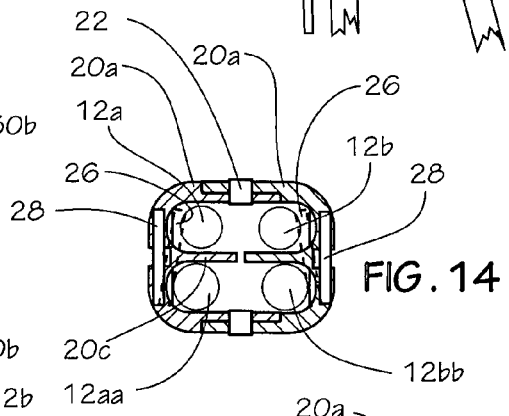
FIG. 14 is a top sectional view similar to FIG. 6 showing an alternate configuration for controlling two parallel ropes simultaneously.
Figure 15:
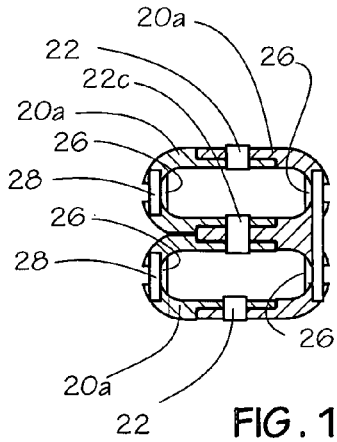
FIG. 15 is another top sectional view showing an alternate configuration for controlling two parallel ropes independently.

When two seconds climb simultaneously, each must be attached to a rope that is pulled up and controlled during ascent. FIGS. 14 and 15 are top sectional views, similar to that of FIG. 6, showing the inventive device configured for handling two ropes (and two seconds) in parallel sot that a belayer can conveniently and safely control the two ropes at the same time. Furthermore, when a single climber uses small diameter ropes in pairs, the alternate configurations of FIGS. 14 and 15 will advantageously enable the belayer to control both ropes simultaneously.

The configuration depicted by FIG. 14 shows body 20*a* and body 20*b* sized to accommodate the placement of two ropes in parallel (FIG. 14 shows cross-sections of rope 12*a* and 12*b*; and second rope 12*aa* and 12*bb*). Rib 20*c* divides the rope opening, which serves to keep the two ropes separated. Alternatively rib 20*c* can be eliminated. The configuration of FIG. 14 controls both ropes simultaneously, for example, if one second falls and the corresponding rope brakes, the rope of the other second will be braked also.

Referring again to FIG. 14, provision can be made to loosely or pivotally mount pinch pins 26 so they will tilt relative to body 20*a* and body 20*b* to accommodate differences in the diameter of the parallel ropes (for example, note that rope 12*a* has a smaller diameter than second rope 12*aa* in FIG. 14). If the diameter of one of the parallel ropes is greater than the other, pinch pins 26 will adjust by tilting (dashed outlines in FIG. 14) so that both ropes are pinched equally.

The configuration depicted by FIG. 15 show two inventive devices side by side sharing a central wall and pivot 22*c*. By sharing a central wall and pivot, the resultant assembly is more compact and lighter than two separate devices side by side. The configuration of FIG. 14 controls each rope independently, that is, if one rope is braked the other rope will remain free to move.

Figure 17:
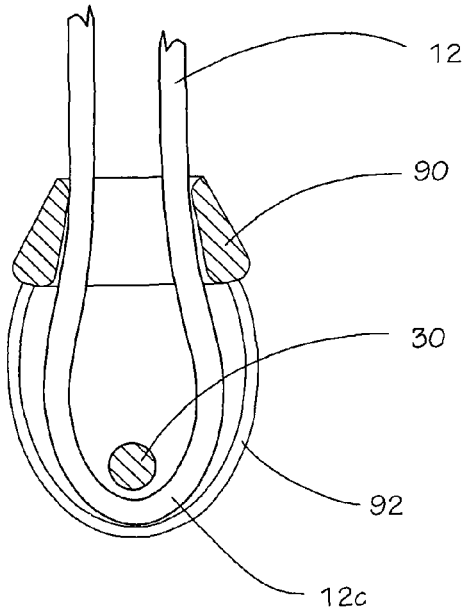
FIG. 17 (Prior Art)
FIG. 17 is a front sectional view of a prior art tube belay device showing the device when rope moves loosely through it.
Figure 18:
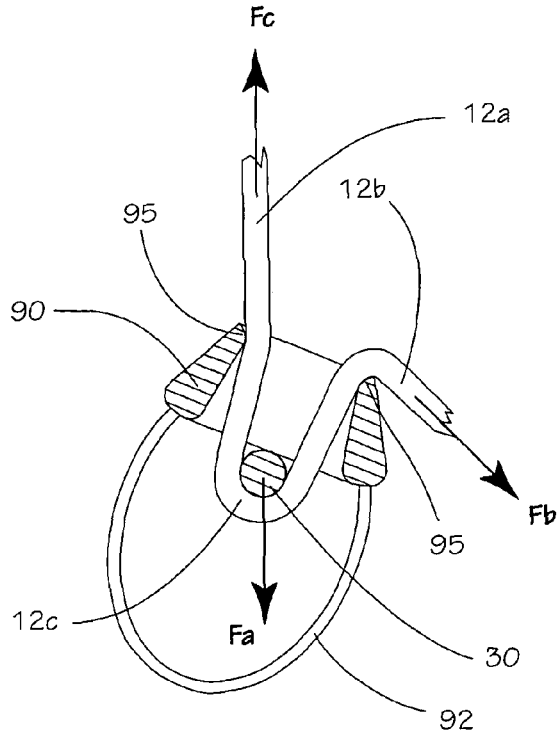
FIG. 18 (Prior Art)
FIG. 18 is a front sectional view of a prior art tube belay device showing the device holding a rope attached to a carabiner.

FIGS. 17 and 18 picture the prior art. FIG. 17 shows prior art belay device 90 with rope 12 slack and able to move freely. When inventive climbing device 10 is relaxed and open as pictured by FIGS. 3 and 7, movement of slack rope through the device is similar to that of the prior art device pictured in FIG. 17.

FIG. 18 shows prior art belay device 90 holding rope 12 under tension. As seen in FIG. 18, to arrest and hold a rope the prior art relies solely on the friction of rope contact with corners 95 and carabiner 30 (the rope is not pinched as shown in FIGS. 4, 8, and 13).

It is understood that those skilled in the art may conceive of other modifications and/or changes to the invention described above. For example, variations on the number and shape of the body parts; the number and locations of the pivot pins or hinges; the type and location of springs; the shape and size of the control lever, and the ability to handle multiple ropes are contemplated. Any such modifications or changes that fall within the purview of the description are intended to be included therein as well. This description is intended to be illustrative and is not intended to be limitative. The scope of the invention is limited only by the scope of the claims appended hereto.

I claim:

1. A climbing device, comprising:

a body including at least two parts pivotally connected that form at least one insertion opening and at least one exit opening at opposite ends of the body;

a spring connected to the two parts of the body in which the spring and pivotal connection force the two parts of the body into a first position;

wherein a bight formed by looping a portion of a rope that doubles back on itself with the bight portion of the rope inserted through the insertion opening and out the exit opening, and a carabiner is attached to the bight portion of the rope;

wherein the two parts of the body and the pivotal connection are configured so that pivoting the two parts of the body against the action of the spring from the first position pinches the bight portion of the rope between the exit opening and the carabiner by decreasing the size of the exit opening.

2. The climbing device of claim 1, wherein the spring is a looped spring that is connected to each of the two parts of the body at locations adjacent the exit opening.

3. The climbing device of claim 1, wherein:

a first part of the body includes an abutment for a second part of the body to limit pivoting movement of the two parts of the body; and the two parts of the body occupy the first position when the second part of the body abuts the first part of the body.

4. The climbing device of claim 1, wherein the insertion opening includes at least one notch.

5. The climbing device of claim 1, wherein:

the two parts of the body form an interior surface and an exterior surface; and the interior surface formed by the two parts of the body includes at least one protrusion adjacent the exit opening characterized in that the protrusion provides friction with the rope when the size of the exit opening is decreased.

6. The climbing device of claim 5, wherein:

the interior surface of the two parts of the body includes at least two protrusions adjacent the exit opening;

the protrusions are opposite each other; and the protrusions are located so that pivoting the two parts of the body from the first position against the action of the spring brings at least two of the protrusions closer together thereby providing friction with the rope.

7. The climbing device of claim 6, wherein the protrusions are formed using pins.

8. The climbing device of claim 1, wherein:

the two parts of the body and the pivotal connection form a substantially straight passage configured so that pivoting the two parts of the body against the action of the spring from the first position causes the size of the exit opening to become smaller than the size of the insertion opening.

9. The climbing device of claim 1, wherein:

the two parts of the body form a substantially straight passage having an interior surface and an exterior surface; and the two parts of the body and the pivotal connection are configured so that pivoting the two parts of the body against the action of the spring from the first position causes at least a portion of the interior surface of the body to slope inwardly from the insertion opening to the exit opening.

10. The climbing device of claim 1, including:

manual control adapted to pivot at least one part of the body so that the size of the exit opening is increased.

11. The climbing device of claim 10, wherein:

the manual control is a handle extending outwardly from the body.

12. The climbing device of claim 1, wherein the spring is at least one torsion spring that is connected to each of the at least two parts of the body at locations adjacent the pivotal connection.

13. The climbing device of claim 1, wherein there are two insertion openings and two corresponding exit openings configured to insert two loops of rope, one loop in each insertion opening and out the corresponding exit opening so that the carabiner is be attached to both loops of rope.

14. The climbing device of claim 1, including:

an attachment opening adapted to attach a second carabiner to at least one part of the body thereby rigging the climbing device to belay a second.

* * * * *